US007126545B2

(12) United States Patent
Nagano et al.

(10) Patent No.: US 7,126,545 B2
(45) Date of Patent: Oct. 24, 2006

(54) ANTENNA UNIT AND PORTABLE RADIO SYSTEM COMPRISING ANTENNA UNIT

(75) Inventors: Kenya Nagano, Kanazawa (JP); Tadashi Oga, Yokosuka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 65 days.

(21) Appl. No.: 10/504,667

(22) PCT Filed: Feb. 14, 2003

(86) PCT No.: PCT/JP03/01575

§ 371 (c)(1),
(2), (4) Date: Oct. 1, 2004

(87) PCT Pub. No.: WO03/069727

PCT Pub. Date: Aug. 21, 2003

(65) Prior Publication Data

US 2006/0017624 A1 Jan. 26, 2006

(30) Foreign Application Priority Data

Feb. 15, 2002 (JP) ..... 2002-038546

(51) Int. Cl.
*H01Q 1/24* (2006.01)

(52) U.S. Cl. ..... 343/702; 343/895

(58) Field of Classification Search ..... 343/702, 343/895, 700 MS, 783, 818, 817, 819, 873
See application file for complete search history.

(56) References Cited

U.S. PATENT DOCUMENTS 5,666,125 A * 9/1997 Luxon et al. ..... 343/702
6,025,811 A 2/2000 Canora et al.
6,046,703 A 4/2000 Wang et al.
6,515,634 B1 * 2/2003 Desclos et al. ..... 343/818

(Continued)

FOREIGN PATENT DOCUMENTS

EP 0 590 671 A1 4/1994

(Continued)

OTHER PUBLICATIONS

Roger Yew-Siow Tay et al., "Dipole Configurations with Strongly Improved Radiation Efficiency for Hand-Held Transceivers", Jun. 1998, pp. 798-806.

*Primary Examiner*—Hoanganh Le
(74) *Attorney, Agent, or Firm*—Pearne & Gordon LLP

(57) ABSTRACT

A subject of the present invention is to provide an antenna unit and a portable radio device capable of attaining a wider bandwidth and a lower SAR.

In the present invention, an antenna element (12) that has an effective length corresponding to a half wavelength of a transmitting frequency and a parasitic element (13) that has an effective length corresponding to a half wavelength of a receiving frequency are provided, an antenna current is induced in the antenna element (12) at the transmitting frequency upon transmitting a radio wave in a predetermined transmitting frequency band, and another antenna current is induced in the parasitic element (13) by a spatial coupling between the antenna element (12) and the parasitic element (13) at the receiving frequency upon receiving the radio wave in a predetermined receiving frequency band, whereby peak points in an antenna current distribution are scattered into two points. Accordingly, a wider bandwidth can be obtained without addition of a matching circuit and also expansion of a parts packaging space on a board and reduction in the number of packaged parts can be achieved.

10 Claims, 9 Drawing Sheets

U.S. PATENT DOCUMENTS

| | | | | |
|---|---|---|---|---|
| 6,765,536 | B1 * | 7/2004 | Phillips et al. | 343/702 |
| 6,781,556 | B1 * | 8/2004 | Kojima et al. | 343/818 |

FOREIGN PATENT DOCUMENTS

| | | |
|---|---|---|
| EP | 1 154 513 A1 | 11/2001 |
| JP | 62-234404 | 10/1987 |
| JP | 10-51223 | 2/1998 |
| JP | 2001-85920 | 3/2001 |
| JP | 2001-313516 | 11/2001 |
| JP | 2001-339215 | 12/2001 |

* cited by examiner

ANTENNA UNIT AND PORTABLE RADIO SYSTEM COMPRISING ANTENNA UNIT

This application is a 371 of PCT/JP03/01575 filed on Feb. 14, 2003.

TECHNICAL FIELD

The present invention relates to an antenna unit used in a portable radio device and a portable radio device equipped with this antenna unit.

BACKGROUND ART

The mobile radio communication system recently spreads. In the portable radio device, or the like, for example, the user anticipates further reduction in size, weight and cost of the device. Also, the portable radio device capable of meeting a plurality of communication systems that make transmission/reception in a plurality of different frequency bands is now investigated. Thus, the user expects the device to handle the frequency bands of a plurality of communication systems by one antenna unit. As a result, a smaller size, a lower cost attained by the reduction in the number of articles and the assembling man-hours, or a wider frequency characteristic to be secured, and so forth are required of the antenna unit that is incorporated into the portable radio device. However, normally the antenna unit tends to have a narrower bandwidth commonly when the size of such antenna unit is reduced smaller.

Meanwhile, as the antenna unit used in the portable radio device in the prior art, e.g., the mobile phone, the antenna unit shown in FIG. 1 is known. In this case, FIG. 1 is an appearance view of the antenna unit showing the state that a whip antenna 202 is pulled out from a conventional mobile phone 200.

This mobile phone 200 has a telescopic antenna unit. The whip antenna 202 starts operation when such whip antenna 202 is pulled out from a housing 201. Also, a helical antenna 203 starts operation when the whip antenna 202 is pushed into the housing 201.

Meanwhile, according to this telescopic antenna unit, the helical antenna 203 of this antenna unit is always protruded from the housing 201 of the mobile phone 200 to the outside, and thus the presence of such protruded portion causes inconvenience to the user upon carrying and operating the phone. In particular, the small-size mobile phone 200 is often put into the user's breast pocket. For this reason, it is possible that the antenna may hit on various things during carried in the rocket, and a physical strength of the antenna cannot be satisfactorily maintained.

Therefore, in order to overcome disadvantages such as troublesome, incomplete physical strength, and the like, the built-in antenna unit whose antenna element is built in the interior of the main body of the portable radio device is known, as disclosed in JP-A-2000-349526, for example.

However, since this built-in antenna unit is arranged in vicinity of the liquid crystal screen, the board, the speaker, etc. which are constituting the portable radio device, such antenna unit is easily affected by these parts. It is known that normally such antenna unit operates in the narrower bandwidth.

For this reason, in many cases the wider bandwidth is realized by providing the matching circuit to the preceding stage of the feeding portion and then adjusting the impedance matching.

However, in the case where the wider bandwidth is realized by the matching circuit, a space in which the matching circuit is mounted must be kept on the printed board in the housing. Thus, there is a possibility that an increase in the mounting space on the printed board and an increase in the number of articles are brought about.

Also, normally the telescopic antenna unit in the prior art is constructed such that such device is unbalancedly fed to flow the antenna current through the housing of the portable radio device. In such unbalanced antenna unit, it is known that the antenna gain is degraded by the influence of the user's hand, and so on when the user holds the portable radio device to use.

Also, this portable radio device is regulated by the law based on SAR (Specific Absorption Rate), and it is requested to suppress the SAR value below a predetermined value. In such portable radio device, normally the state in which the user puts the portable radio device to his or her ear to contact closely to the head of the human body and speaks upon the phone, and so forth, for example, are considered as "the state in which the SAR value is increased". Thus, according to the regulation by the law, further reduction in the SAR value is driven by necessity.

Therefore, as approaches of reducing the SAR value during the speaking in the prior art, three approaches described in the following are considered, for example.

First, it is known that the SAR value can be reduced by increasing an air clearance between the antenna unit and the head of the human body. Since normally the earpiece portion comes closest to the ear during the speaking, mainly a distance between the earpiece portion and the ear should be extended herein. However, in order to increase this air clearance, the antenna element must be positioned away from the head of the human body during the speaking by enlarging the housing of the portable radio device, for example. Thus, there is a possibility of causing an increase of the device in size.

Second, it is known that the SAR value can be reduced by reducing a set value of the maximum sending power. However, there is a possibility that the communication quality in the weak electric field area cannot be kept when the set value is reduced.

Third, as disclosed in JP-A-11-307144, the SAR value can be reduced by increasing an air clearance between a peak point of the antenna current (a point at which the largest antenna current is generated) and the head of the human body. This approach is available in the configuration in which the peak point is separated away from the head of the human body during the speaking. However, in the antenna unit having the configuration set forth in this publication, the peak point of the antenna current is only one and thus the peak point comes close to the head of the human body according to a mode of use of the user. Thus, there is a possibility of increasing the SAR value.

Here, the SAR value as the object of the law regulation is the numerical value used when the radio wave is radiated from the antenna unit provided to the portable radio device. Since there is no need to take account of such value upon receiving the radio wave, only the transmission band should be checked.

Next, FIG. 2 is an explanatory view showing the radiation directivity when a parasitic element 213 is brought close to an antenna element 212.

In FIG. 2, the antenna element 212 is a monopole antenna whose effective length is a half wavelength ($\lambda/2$) of a transmitted wavelength ($\lambda$), and is fed from a feeding portion 214. In contrast, the parasitic element 213 is formed of a wire, or the like, for example, whose length is shorter than the half wavelength (λ/2), and is arranged in the proximity of the antenna element 212.

In the case of an antenna unit 210 having such configuration, it is known that the parasitic element 213 operates as a waveguide element and thus the radiation directivity of the antenna unit 210 becomes strong in the +X direction rather than the −X direction.

As explained above, normally the bandwidth of the above conventional antenna unit is liable to become narrower when the reduction of the antenna unit in size is advanced.

Also, in the case of the above conventional telescopic antenna unit, there are the problems that the protrusion of the antenna unit from the portable radio device causes inconvenience upon carrying and operating the phone, and in addition the physical strength cannot be kept.

Also, since the above conventional built-in antenna unit disclosed in above JP-A-2000-349526 is arranged in vicinity of the liquid crystal screen, the board, the speaker, etc. constituting the portable radio device, normally the bandwidth tends to become narrow.

Also, in the above conventional unbalanced antenna unit, there is the problem that the antenna gain is degraded by the influence of the user's hand when the user holds the portable radio device to use.

Also, in the above conventional portable radio device, the increase in size of the device is brought about when the air clearance between the antenna unit and the head of the human body is increased during the speaking state to reduce the SAR value.

Also, in the above conventional portable radio device, there is the disadvantage that the communication quality is degraded in the weak electric field area when the set value of the maximum sending power is decreased to reduce the SAR value.

Here, current distributions 222 to 252 and current peak points 221 to 251 in respective antennas of a half-wave monopole antenna 220, a one-wave monopole antenna 230, a half-wave dipole antenna 240, and a one-wave dipole antenna 250 will be explained with reference to FIGS. 3(A) to (D) hereunder.

As shown in these Figures, it is appreciated in these monopole antennas and dipole antennas that, in the case of the half wavelength, the current peak points 221 to 251 are positioned in one center point of the antenna element respectively and, in the case of the one wavelength, the current peak points are scattered into two points respectively.

On the contrary, in the antenna unit set forth in above JP-A-11-307144, there are the problems that the peak point of the antenna current is only at one location, and the peak point comes close to the head of the human body according to change in the using situation of the user, and thus the SAR value is apt to increase.

Therefore, the present invention has been made in light of above circumstances, and it is an object of the present invention to provide an antenna unit and a portable radio device capable of realizing a wider band and realizing a good antenna performance by controlling the radiation directivity and in addition reducing SAR.

DISCLOSURE OF THE INVENTION

First, an antenna unit of the present invention provides an antenna unit used in a portable radio device, said antenna unit comprising an antenna element and a parasitic element, wherein the antenna element has an effective length corresponding to a half wavelength or one wavelength of a transmitting frequency, to induce an antenna current that radiates the transmitting frequency upon transmitting a radio wave in a predetermined transmitting frequency band, and wherein the parasitic element has an effective length corresponding to a half wavelength of a receiving frequency, to induce another antenna current by a spatial coupling with the antenna element upon receiving the radio wave in a predetermined receiving frequency band.

According to this configuration, the antenna current is induced in the antenna element at the transmitting frequency, while another antenna current is induced in the parasitic element at the receiving frequency by the spatial coupling between the antenna element and the parasitic element. Therefore, a wider bandwidth can be obtained without provision of a matching circuit and also expansion of a parts packaging space on a board and reduction in the number of packaged parts can be achieved.

Also, in the radio communication system in which a frequency in the transmitting band is lower than a frequency in the receiving band, the radiation directivity can be easily directed to the outside of the portable radio device and thus the good antenna performance can be obtained.

Also, in the case of the antenna element whose effective length corresponds to one wavelength, the radio wave is emitted mainly from the antenna element at the time of transmission whereas the radio wave is emitted slightly by the coupling from the parasitic element whose effective length corresponds to one wavelength. Therefore, the peak point of the antenna current can be scattered into three points in total, i.e., two peak points of the current in the one-wave element and one peak point of the current in the half-wave element, and thus the SAR value can be reduced.

Similarly, in the case of the antenna element whose effective length corresponds to one wavelength, in the radio communication system in which the frequency in the transmitting band is set lower than the frequency in the receiving band, the radiation directivity can be easily directed to the outside of the portable radio device and thus the good antenna performance can be obtained.

Second, an antenna unit of the present invention provides an antenna unit used in a portable radio device, said antenna unit comprising an antenna element and a parasitic element, wherein the antenna element has an effective length corresponding to a half wavelength of a receiving frequency, to induce an antenna current upon receiving a radio wave in a predetermined receiving frequency band, and wherein the parasitic element has an effective length corresponding to a half wavelength of a transmitting frequency, to induce another antenna current by a spatial coupling with the antenna element upon transmitting the radio wave in a predetermined transmitting frequency band.

Accordingly, in this configuration, the antenna current is induced in the antenna element at the receiving frequency, while another antenna current is induced in the parasitic element at the transmitting frequency by the spatial coupling between the antenna element and the parasitic element. Therefore, the wider bandwidth can be obtained without provision of the matching circuit and also expansion of the parts packaging space on the board and reduction in the number of packaged parts can be achieved.

Also, similarly to the first invention, in the radio communication system in which the frequency in the transmitting band is set higher than the frequency in the receiving band, the radiation directivity can be easily directed to the outside of the portable radio device and thus the good antenna performance can be obtained.

Third, an antenna unit of the present invention provides an antenna unit used in a portable radio device that executes transmission/reception based on a communication system using radio waves in a plurality of different wavelength bands, said antenna unit comprising an antenna element and a parasitic element, wherein the antenna element has an effective length corresponding to a half wavelength or one wavelength of a frequency in one communication system, to induce an antenna current upon using one communication system, and where the parasitic element has an effective length corresponding to a half wavelength of a frequency in other communication system, to induce another antenna current in the parasitic element by a spatial coupling with the antenna element upon using the other communication system.

According to this configuration, the antenna current is induced in the antenna element during the operation of one communication system, while another antenna current is induced in the parasitic element by the spatial coupling between the antenna element and the parasitic element during the operation of the other communication system. Therefore, the wider bandwidth can be obtained without provision of the matching circuit and also expansion of the parts packaging space on the board and reduction in the number of packaged parts can be achieved.

Also, the radio wave is radiated from the half-wave or one-wave antenna element and the half-wave parasitic element, both being coupled electrically with each other. Therefore, the peak point of the antenna current can be scattered into three points and thus the SAR value can be reduced.

Fourth, in the antenna unit of the present invention, in the antenna unit that is employed in the portable radio device, in the portable radio device of the first or third invention, the portable radio device further comprises an earpiece portion, and a distance between the earpiece portion and the antenna element is set larger than a distance between the earpiece portion and the parasitic element.

According to this configuration, the earpiece portion such as a speaker, or the like for transmitting the speaking contents to the user is provided. Since the antenna current is induced mainly in the antenna element at the time of transmission, the air clearance between the user's ear and the peak point of the antenna current is enlarged and thus the SAR value can be reduced.

In contrast, the antenna current is induced mainly in the parasitic element at the time of reception, and thus the air clearance between the user's ear and the peak point of the antenna current becomes smaller than that at the time of transmission. But the SAR value is the numerical value that is required only of the transmission, and therefore no problem arises at the time of reception.

Fifth, in the antenna unit of the present invention, in the antenna unit that is employed in the portable radio device, in the second invention, the portable radio device further comprises an earpiece portion, and a distance between the earpiece portion and the antenna element is set shorter than a distance between the earpiece portion and the parasitic element.

According to this configuration, since the antenna current is induced mainly in the parasitic element at the time of transmission, the air clearance between the user's ear and the peak point of the antenna current is enlarged and thus the SAR value can be reduced.

In contrast, the antenna current is induced mainly in the antenna element at the time of reception, and thus the air clearance between the user's ear and the peak point of the antenna current becomes smaller than that at the time of transmission. But the SAR value is the numerical value that is required only of the transmission, and therefore no problem arises at the time of reception.

Sixth, in the antenna unit of the present invention, in the antenna unit according to any one of the first to fifth inventions, the antenna element and the parasitic element are formed by printed patterns on a sheet of printed board.

According to this configuration, the antenna element and the parasitic element can be formed on a sheet of printed board, and thus the number of articles can be reduced.

As a result, the air clearance between the antenna element and the parasitic element can be fixed with high precision and also such configuration is excellent in the mass-producibility.

Seventh, in the antenna unit of the present invention, in the antenna unit according to the sixth invention, electronic parts are packaged on the printed board.

According to this configuration, the matching circuit of the antenna unit, which is originally mounted on the main board on which the ICs such as the radio portion, the logic portion, etc. are to be mounted, can be packaged on another board. Thus, a packaging space on the main board can be extended.

Eighth, in the antenna unit of the present invention, in the antenna unit according to any one of the first to fifth inventions, the portable radio device further comprises a radio portion and a printed board on which the radio portion is mounted, and the antenna element and the parasitic element are formed by printed patterns on the printed board.

According to this configuration, the antenna element and the parasitic element can be formed on the main board, and thus the number of articles can be reduced.

Ninth, in the antenna unit of the present invention, in the antenna unit according to any one of the first to eighth inventions, any one or both of the antenna element and the parasitic element is or are shaped like a meander shape.

According to this configuration, any one or both of the antenna element and the parasitic element may be shaped in small size.

Tenth, in the antenna unit of the present invention, in the antenna unit according to any one of the first to ninth inventions, the antenna element is balancedly fed.

According to this configuration, degradation of the antenna gain of the antenna unit caused by the influence of the user's hand can be reduced in the frequency band in which the antenna current is induced mainly in the antenna element to communicate Eleventh, in the antenna unit of the present invention, the antenna element and the parasitic element are arranged in an interior of a housing of the portable radio device.

According to this configuration, since the antenna is never exposed to the outside of the housing, the antenna unit and the portable radio device, which are by no means damaged by the contact, have a high reliability, and are convenient to use, can be realized.

Also, a portable radio device of the present invention having the antenna unit set forth in any one of the first to tenth inventions.

According to this configuration, since any one of above antenna units is provided, the portable radio device having the same advantages as those achieved by the antenna units can be realized.

Figure 1:
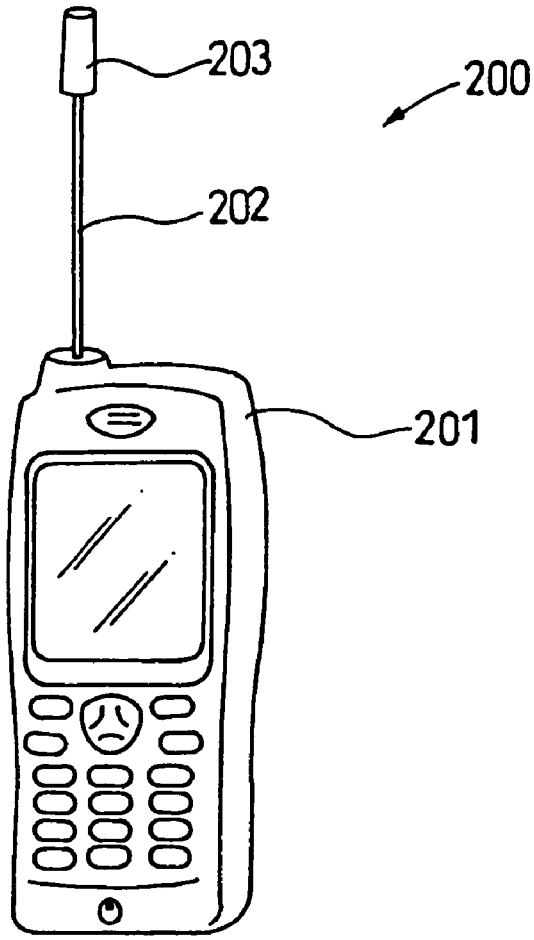
FIG. 1 is a schematic perspective view of a mobile phone in the prior art.
Figure 2:
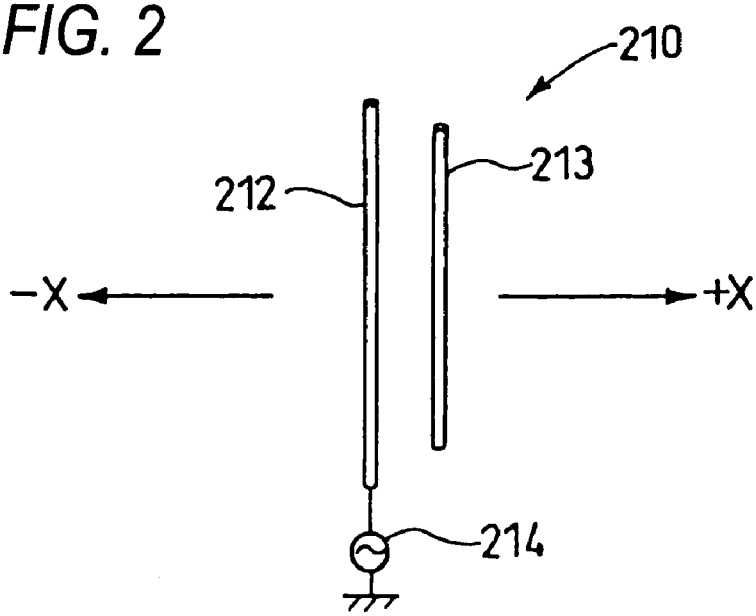
FIG. 2 is an explanatory view showing the radiation directivity when a parasitic element is brought close to a conventional antenna element.
Figure 3:
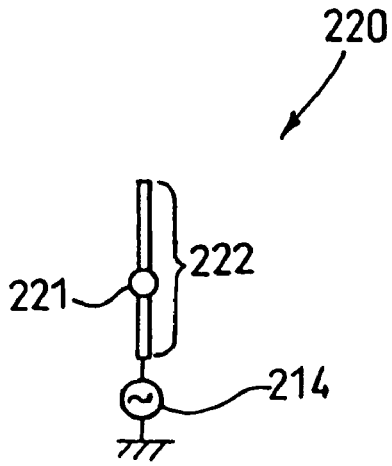
FIGS. 3(A) to (D) are views showing a current distribution in the conventional monopole antenna and a peak point of the current respectively, wherein (A) and (C) show the conventional monopole antenna and (B) and (D) show the conventional dipole antenna.
Figure 3:
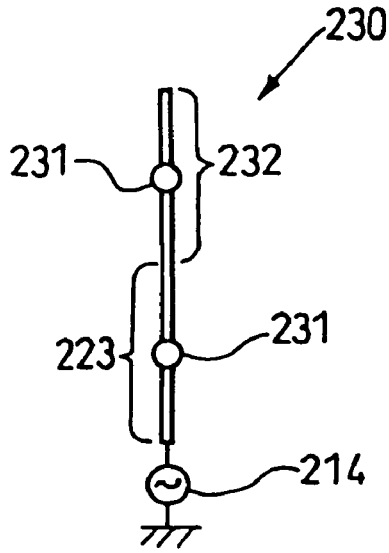
Figure 3:
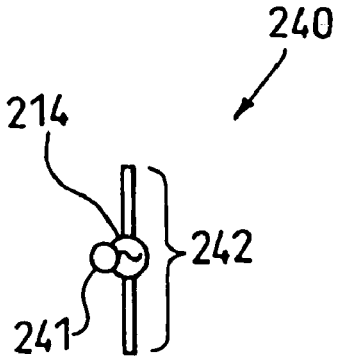
Figure 3:
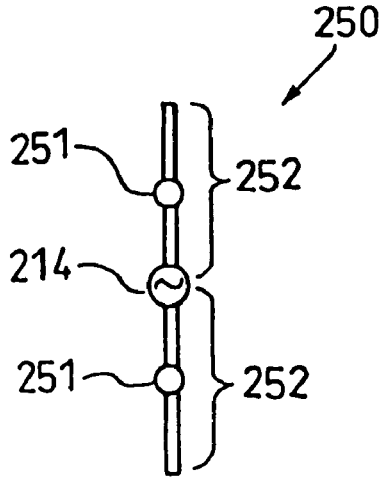

In above Figures, a reference numeral 10 refers to a mobile phone, 11 (rod-like) to a housing, 11A to an upper housing, 11B to a lower housing, 12 to an antenna element, 13 to a parasitic element, 14 to a feeding portion, 20 to a mobile phone, 22 to an antenna element, 23 to a parasitic element, 30 to a mobile phone, 32 to an antenna element, 33 to a parasitic element, 40 to a mobile phone, 42 to an antenna element, 43 to a parasitic element, 50 to a mobile phone, 52 to an earpiece portion, 52A to a listening point, 60 to a mobile phone, 62 to an earpiece portion, 62A to a listening point, 70 to a mobile phone, 71 to a main board, 72 to a printed board, 74 to a feeding pin, 80 to a mobile phone, 82 to a printed board, 83 to a main board, 84 to a packaged parts, 85 to a connector connection terminal, 86 to a coaxial cable, 87 to a radio portion, 90 to a mobile phone, 91 to a liquid crystal display portion (LCD), 92 to a printed board, 93 to a radio portion, 94 to a coaxial cable, 100 to a mobile phone, 102 to a printed board, 104 to a feeding portion, 110 to a mobile phone, 120 to a mobile phone, and α, β, γ to an electrode (pole).

BEST MODE FOR CARRYING OUT THE INVENTION

Embodiments of the present invention will be explained in detail with reference to the accompanying drawings hereinafter.

First Embodiment

Figure 4:
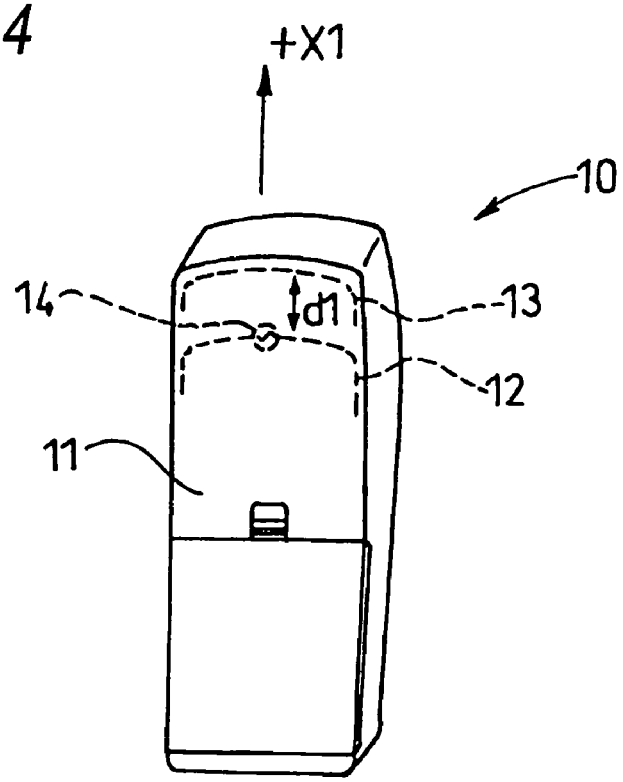
FIG. 4 is a schematic perspective view showing a mobile phone into which an antenna unit according to a first embodiment is incorporated.

FIG. 4 is an appearance view of the back surface side of a mobile phone 10 of a W-CDMA (Wideband Code Division Multiple Access) system into which an antenna unit according to a first embodiment of the present invention is incorporated. FIG. 4 shows a perspective view when a not-shown LCD (Liquid Crystal Display) screen and a key portion are arranged to direct toward the back of this sheet. In this case, as with the transmitted/received frequencies in this W-CDMA system, the transmitting frequency is set to 1920 MHz to 1980 MHz and the receiving frequency is set to 2110 MHz to 2170 MHz.

The mobile phone 10 shown in FIG. 4 has an antenna element 12 and a parasitic element 13 in a rod-like housing 11. For example, a size of this housing 11 has a length of 110 mm in the longitudinal direction, a length of 40 mm in the width direction, and a length of 15 mm in the thickness direction. The LCD and the key portion, although not shown, are arranged on an upper portion and a lower portion of a surface of the housing 11.

The antenna element 12 is composed of a half-wave dipole antenna that is fed from a feeding portion 14 in the antenna center, and an effective length corresponds to a half wavelength ($v/fe \times 1/2$, v: light velocity) of the transmitting frequency (fe). In the case of the present embodiment, this antenna element is formed of an about 77 mm copper wire.

Meanwhile, in order to make it possible for the radio wave to arrive at the antenna element 12 effectively without generation of the standing wave in the case where no parasitic element 13 is arranged, it is preferable that a VSWR (Voltage Standing Wave Ratio) value should be suppressed lower than 2.5. Therefore, in the case of the present embodiment, the transmitting frequency band is set to almost 1910 to 1990 MHz in the antenna element 12. Thus, the bandwidth is set to almost 80 MHz.

The parasitic element 13 is pasted onto an upper end surface of the interior of the housing 11, for example, and an effective length corresponds to a half wavelength ($v/fr \times 1/2$, v: light velocity) of the receiving frequency (fr). In the case of the present embodiment, this parasitic element is formed of an about 70 mm copper wire. Also, the parasitic element 13 is arranged in the proximity of the antenna element 12 at an air clearance d of about 10 mm.

Also, the receiving frequency of the parasitic element 13 is set to 2100 to 2170 MHz because the VSWR value is set to about 2.5 or less.

Next, an operation of the antenna unit in the present embodiment will be explained hereunder.

The radiation of the radio wave is executed from both the balanced antenna element 12 excited by the feeding portion 14 and the parasitic element 13 that is coupled electrically with the antenna element 12. The antenna element 12 mainly operates as a radiator in a transmitting band, and also the parasitic element 13 operates as a receiver in a receiving band. Therefore, the frequency band of this antenna unit in which the VSWR is 2.5 or less exists in about 1910 to 1990 MHz and about 2100 to 2179 MHz, and also a sum of bandwidths becomes about 150 MHz. The incorporation of the parasitic element 13 yields the wider bandwidth.

Also, in the antenna unit in the present embodiment, the electrical coupling strength is changed in dependence on the air clearance d between the antenna element 12 and the parasitic element 13. As a result, in the case where the effective length of the antenna element 12 correspond to a half wavelength of the transmitting frequency in the situation that no parasitic element 13 is incorporated, sometimes the resonance frequency in the transmitting band is changed after the parasitic element 13 is incorporated into the device.

In such case, the resonance frequency must be mated with the transmitting frequency by finely adjusting an element length of the antenna element 12 while the parasitic element 13 is incorporated. Consequently, the effective length of the antenna element 12 after the parasitic element 13 is incorporated is given as a length obtained when the resonance is generated at the frequency fe of 1920 to 1980 MHz.

For instance, suppose in this embodiment that the wavelength of the radio wave when the transmission is carried out at the transmitting frequency (fe) is (λe) and also the effective length of the antenna element 12 corresponds to the half wavelength (λe/2), the element length (L) is given by $$L = \lambda e/2 \quad (1)$$
$$= v/(2fe)$$

where v: propagation velocity of the radio wave (light) Hence, the element length of the antenna element 12 is derived as 75.7 mm to 78.1 mm from Equation (1).

Similarly, the effective length of the parasitic element 13 must also be finely adjusted, and is derived as a length that resonates at the receiving frequency fr of 2110 to 2170 MHz when incorporated.

For instance, suppose that the half wavelength (λr/2) of the wavelength (λr) of the radio wave at this receiving frequency (fr) corresponds to the effective length of the parasitic element 13, the element length (L) of the parasitic element 13 is derived as 69.1 mm to 71.0 mm.

In this case, the effective length of the antenna element 12 must be adjusted within a range of ±10% after the parasitic element 13 is incorporated since such antenna element is also coupled weakly with the parasitic element 13 at the transmitting frequency. Therefore, in this embodiment, the length of the antenna element is set to almost 77 mm as described above.

Similarly, the effective length of the parasitic element 13 must be adjusted within a range of ±10% after this parasitic element 13 is incorporated. Therefore, in this embodiment, the length of the parasitic element 13 is set to almost 70 mm as described above.

Also, the radiation directivity of the present antenna unit results in the strong radiation in the +X1 direction rather than the −X1 direction since the parasitic element 13 acts as the waveguide element. Since the transmitting frequency is lower than the receiving frequency in the W-CDMA system, the above radiation directivity can be obtained by pasting the parasitic element 13 whose element length is shorter than the antenna element 12 onto the upper end surface of the interior of the housing 11.

Also, the degradation of the antenna gain is easily brought about by the influence of the not-shown board and electronic parts in the housing 11 if the radiation in the (−X1) direction of the inside of the housing 11 is enhanced conversely to the configuration in this embodiment. But the good antenna performance can also be obtained by enhancing the radiation in the outward direction as in this embodiment.

In this manner, according to the present embodiment, the antenna current is induced in the antenna element 12 at the transmitting frequency, while the antenna current is induced in the parasitic element 13 at the receiving frequency by the spatial coupling between the antenna element 12 and the parasitic element 13. Therefore, the bandwidth can be expanded without addition of the matching circuit, and also expansion of the parts packaging space on the board and reduction in the number of packaged parts can be achieved.

Also, according to the present embodiment, in the radio communication system in which the frequency in the transmitting band is lower than the frequency in the receiving band, the radiation directivity can be easily directed to the outside of the portable radio device and thus the good antenna performance can be obtained.

In this case, the similar advantages can be achieved even though the antenna element 12 and the parasitic element 13 are formed of a strip-like metal plate, for example. Also, the method of pasting the antenna element 12 and the parasitic element 13 onto the inner wall surface of the housing 11 merely shows an example of the antenna holding method. In summary, the similar advantages can be achieved by holding appropriately the antenna element 12 and the parasitic element 13 in their adequate positions in the interior of the housing 11. In this event, the similar advantages can be achieved even though a monopole antenna whose effective length corresponds to the half wavelength is used as the antenna element 12.

Second Embodiment

Figure 5:
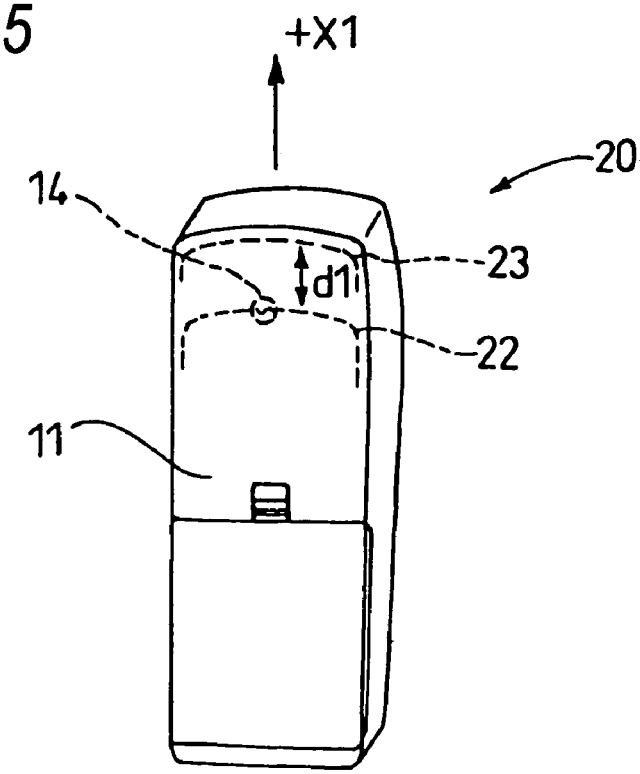
FIG. 5 is a schematic perspective view showing a mobile phone into which an antenna unit according to a second embodiment is incorporated.

FIG. 5 is a perspective appearance view showing a mobile phone 20 corresponding to a particular communication system into which an antenna unit according to a second embodiment of the present invention is incorporated. In this case, in this embodiment, the same reference symbols are affixed to the same portions as those in the first embodiment and their duplicate explanation will be avoided herein.

The mobile phone 20 in the present embodiment has the same basic configuration as that of the mobile phone 10 shown in FIG. 4 in the first embodiment. As the communication system used herein, for example, the receiving frequency of 2300 MHz to 2350 MHz and the transmitting frequency of 2400 MHz to 2450 MHz are employed respectively and the receiving frequency is set lower than the transmitting frequency conversely to the first embodiment.

The mobile phone 20 shown in FIG. 5 has an antenna element 22 and a parasitic element 23 in the rod-like housing 11. A size of the housing 11 has a length of 110 mm in the longitudinal direction, a length of 40 mm in the width direction, and a length of 15 mm in the thickness direction, like the first embodiment.

The antenna element 22 is composed of a half-wave dipole antenna that is fed from the antenna center, and is formed of a copper wire whose effective length corresponds to the half wavelength of the receiving frequency, i.e., whose length is about 65 mm. Here, in the case where no parasitic element 23 is arranged, the frequency band of the mobile phone 20 in which the VSWR is 2.5 or less exists in about 2270 to 2360 MHz and also the bandwidth is almost 90 MHz.

The parasitic element 23 is pasted onto the upper end surface of the interior of the housing 11 while such parasitic element comes close to the antenna element 22 at the air clearance d of about 10 mm, and is formed of a copper wire whose effective length corresponds to the half wavelength of the transmitting frequency, i.e., whose length is about 62 mm.

Next, an operation of the antenna unit in the second embodiment will be explained hereunder. The radiation of the radio wave is executed from both the balanced antenna element 22 excited by the feeding portion 14 and the parasitic element 23 that is coupled electrically with the antenna element 22. The antenna element 22 mainly operates as the receiver in the receiving band, while the parasitic element 23 operates as the radiator in the transmitting band.

In this embodiment, the frequency band of this antenna unit in which the VSWR is 2.5 or less exists in about 2270 to 2360 MHz and about 2390 to 2490 MHz, and also a sum of bandwidths becomes about 190 MHz. Thus, the incorporation of the parasitic element 23 yields the wider bandwidth.

Also, the radiation directivity of the present antenna unit results in the strong radiation in the +X1 direction rather than the −X1 direction since the parasitic element 23 acts as the waveguide element. Since the receiving frequency is lower than the transmitting frequency in this communication system, the above radiation directivity can be obtained by pasting the parasitic element 23 whose element length is shorter than the antenna element 22 onto the upper end surface of the interior of the housing 11.

Also, the degradation of the antenna gain is easily brought about by the influence of the not-shown board and electronic parts in the housing 11 if the radiation to the inward direction of the housing 11 is enhanced conversely to the present embodiment. But the good antenna performance can be obtained by enhancing the radiation in the outward direction of the housing 11 as in this embodiment.

In this manner, according to the present embodiment, the antenna current is induced in the antenna element 22 at the receiving frequency, while the antenna current is induced in the parasitic element 23 at the transmitting frequency by the spatial coupling between the antenna element 22 and the parasitic element 23. Therefore, the bandwidth can be expanded without addition of the matching circuit, and also expansion of the parts packaging space on the board and reduction in the number of packaged parts can be achieved.

Also, according to the present embodiment, such a radio communication system is constructed that the parasitic element 23 serving as the radiator in the transmitting band is arranged closer to the outside of the housing 11 than the antenna element 22 serving mainly as the receiver in the receiving band and also the frequency in the receiving band is set lower than the frequency in the transmitting band. Therefore, the radiation directivity can be easily directed to the outward of the portable radio device and thus the good antenna performance can be obtained.

In the present embodiment, the length of the antenna element 22 must be adjusted within a range of ±10% after the parasitic element 23 is incorporated since the antenna element is also coupled weakly with the parasitic element 23 at the receiving frequency. Similarly, the length of the parasitic element 23 must also be adjusted within a range of +10% after the parasitic element is incorporated.

Also, the similar advantages can be achieved even though the strip-like metal plate is used as the antenna element 22 and the parasitic element 23. Also, in the present embodiment, the method of pasting the antenna element 22 and the parasitic element 23 onto the inner wall of the housing 11 merely shows an example of the antenna holding method. In summary, the similar advantages can be achieved by holding appropriately the antenna element 22 and the parasitic element 23 in their adequate positions in the housing 11. In this event, the similar advantages can be achieved even though a monopole antenna whose effective length corresponds to the half wavelength is used as the antenna element 22.

Third Embodiment

Figure 6:
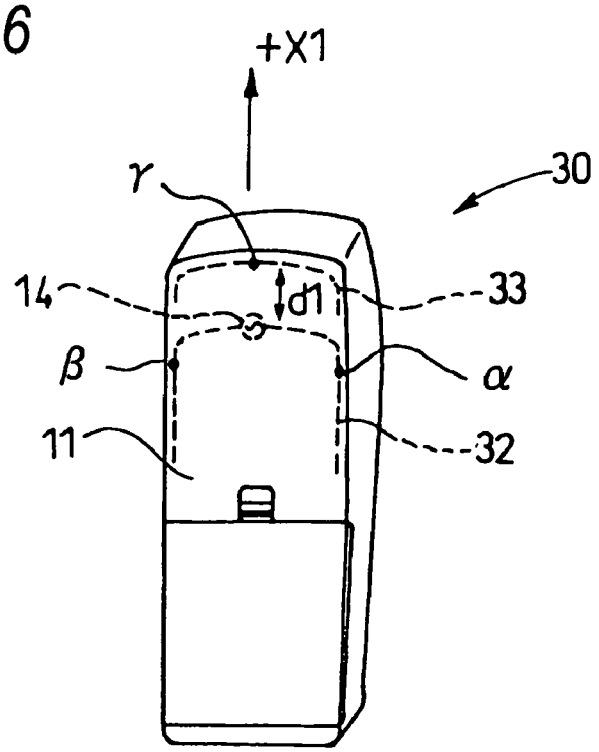
FIG. 6 is a schematic perspective view showing a mobile phone into which an antenna unit according to a third embodiment is incorporated.

FIG. 6 is an appearance view of a mobile phone 30 of the W-CDMA system into which an antenna unit according to a third embodiment is incorporated. In this case, in this embodiment, the same reference symbols are affixed to the same portions as those in the first embodiment and their duplicate explanation will be avoided herein.

The mobile phone 30 shown in FIG. 6 has the same basic configuration as the mobile phone 10 in the first embodiment, and has an antenna element 32 and a parasitic element 33 in the rod-like housing 11. Also, in the mobile phone 30 in the present embodiment, a length in the longitudinal direction of the housing 11 is 110 mm, a length in the width direction is 40 mm, and a length in the thickness direction is 15 mm. As with the transmitting/receiving frequencies in this W-CDMA system, as described in the first embodiment, the transmitting frequency is 1920 MHz to 1980 MHz while the receiving frequency is 2110 MHz to 2170 MHz.

In the antenna unit in the present embodiment, points α, β, γ indicated by a black dot at three locations in FIG. 6 give a peak point of the antenna current distribution in the transmitting band of this antenna unit respectively. The peak point is scattered into three points. Out of three peak points α, β, γ, two points α, β on the antenna element 301 have a larger current value than one point γ on the parasitic element 303. This is because most of the radio waves in the transmitting band are radiated from this antenna element 32.

The antenna element 32 is composed of a one-wave dipole antenna fed from the antenna center, and the effective length corresponds to one wavelength of the transmitting frequency. The antenna element is formed of a copper wire having a length of about 144 mm. In the case where the parasitic element 33 is not arranged, the transmitting frequency band in which the VSWR is 2.5 or less exists in about 1910 to 1990 MHz, like the first embodiment, and the bandwidth is about 80 MHz.

The parasitic element 33 is pasted onto the upper end surface of the interior of the housing 11, like the first embodiment, and is formed of a copper wire whose effective length corresponds to the half wavelength of the receiving frequency, i.e., whose length is about 70 mm. Also, the parasitic element 33 is arranged in the vicinity of the antenna element 32 at the air clearance d of about 10 mm.

Also, in the present embodiment, the length of the antenna element 32 must be adjusted within a range of +10% after the parasitic element 33 is incorporated. Similarly, the length of the parasitic element 33 must also be adjusted within a range of ±10% after the parasitic element is incorporated.

Next, an operation of the antenna unit in the present embodiment will be explained hereunder.

The transmission/reception of the radio wave are executed by the balanced antenna element 32 excited by the feeding portion and the parasitic element 33 that is coupled electrically with the antenna element 32. The antenna element 32 mainly acts as the radiator in the transmitting band, while the parasitic element 33 acts as the receiver in the receiving band.

Thus, as in the first embodiment, the frequency band of this antenna unit in which the VSWR is 2.5 or less exists in about 1910 to 1990 MHz and about 2100 to 2170 MHz, and also a sum of bandwidths becomes about 150 MHz. Thus, the incorporation of the parasitic element 23 gives the wider bandwidth.

Also, the radiation directivity of the present antenna unit results in the strong radiation in the +X1 direction rather than the −X1 direction since the parasitic element 33 acts as the waveguide element. As described above, since the transmitting frequency is lower than the receiving frequency in the W-CDMA system, the above radiation directivity can be obtained by pasting the parasitic element 33 whose element length is shorter than the antenna element 32 onto the upper end surface of the interior of the housing 11.

Also, in this embodiment, the degradation of the antenna gain is easily brought about by the influence of the board and electronic parts in the housing 11 if the radiation to the inward direction of the housing 11 is enhanced. But the good antenna performance can be obtained by enhancing the radiation in the outward direction, like the third embodiment.

Also, the SAR value can be reduced because the peak points in the antenna current distribution are scattered into three points α, β, γ.

In this embodiment, like the first embodiment, the antenna current is induced in the antenna element 32 at the transmitting frequency, while the antenna current is induced in the parasitic element 33 at the receiving frequency by the spatial coupling between the antenna element 32 and the parasitic element 33. Therefore, the bandwidth can be expanded without addition of the matching circuit, and also expansion of the parts packaging space on the board and reduction in the number of packaged parts can be achieved.

Also, since the W-CDMA system in which the frequency in the transmitting band is set lower than the frequency in the receiving band is employed as the radio communication system in this embodiment, the radiation directivity can be easily directed to the outward of the portable radio device and thus the good antenna performance can be obtained. Also, the SAR value can be reduced because of the lower transmitting frequency. Also, the similar advantages can be achieved even though the strip-like metal plate is used as the antenna element 301 and the parasitic element 303.

In this embodiment, the method of pasting the antenna element 32 and the parasitic element 33 onto the inner wall of the housing 11 merely shows one mode of the antenna holding method. The similar advantages can be achieved by holding appropriately the antenna element 32 and the parasitic element 33 in their adequate positions in the interior of the housing 11.

Fourth Embodiment

Figure 7:
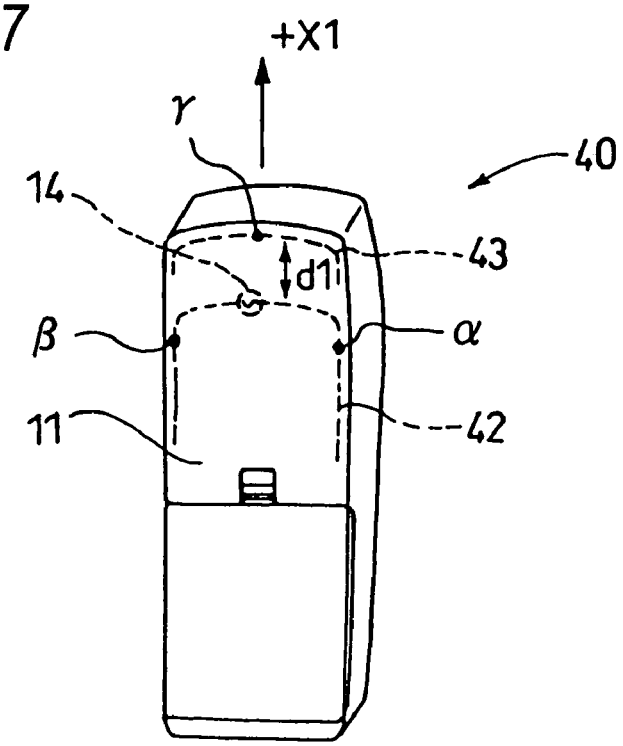
FIG. 7 is a schematic perspective view showing a mobile phone into which an antenna unit according to a fourth embodiment is incorporated.

FIG. 7 is an appearance view showing a dual-band mobile phone 40 of the city phone (1.5 GHz PDC) system and the PHS system into which an antenna unit according to a fourth embodiment of the present invention is incorporated. In this case, in this embodiment, the same reference symbols are affixed to the same portions as those in the first embodiment and their explanation will be omitted herein.

The mobile phone 40 shown in FIG. 7 has the same basic configuration as that of the mobile phone 10 shown in FIG. 4 in the first embodiment, and has an antenna element 42 and a parasitic element 43 in the rod-like housing 11. Here, the housing 11 of the mobile phone 40 has the same lengths in the longitudinal direction, the width direction, and the thickness direction as the housing 11 in the first embodiment respectively.

In the antenna unit shown in FIG. 7, peak points in the current distribution indicate the peak point of the antenna current upon using the city phone system, and are scattered into three points α, β, γ. In three points α, β, γ, two points α, β on the antenna element 42 have a larger current value than one point γ on the parasitic element 43. This is because most of the radio waves upon using the city phone system are radiated from the antenna element 42.

The antenna element 42 is composed of the one-wave dipole antenna fed from the antenna center, and the effective length corresponds to one wavelength of the frequency in the city phone system. The antenna element is formed of a copper wire having a length of about 206 mm. Where the transmitting/receiving frequencies in the city phone system are 1429 MHz to 1501 MHz (the transmitting band 1429 to 1453 MHz, the receiving band 1477 to 1501 MHz), and the frequency band in the PHS is 30 MHz around 1900 MHz. In the case where the parasitic element 43 is not arranged, the frequency band in which the VSWR is 2.5 or less exists in about 1425 to 1505 MHz, and the bandwidth is about 80 MHz.

The parasitic element 43 is arranged in the proximity of the antenna element 42 at the air clearance d of about 10 mm, and pasted onto the upper end surface of the interior of the housing 11. The parasitic element 43 in this embodiment is formed of a copper wire whose effective length corresponds to the half wavelength of the receiving frequency, i.e., whose length is about 79 mm.

Also, in the present embodiment, the length of the antenna element 42 must be adjusted within a range of ±10% after the parasitic element 43 is incorporated since such antenna element is also coupled weakly with the parasitic element 43 at the frequency corresponding to the city phone. Similarly, the length of the parasitic element 43 must also be adjusted within a range of ±10% after the parasitic element 43 is incorporated. Next, an operation of the antenna unit in the fourth embodiment will be explained hereunder.

The transmission/reception of the radio wave are executed by the balanced antenna element 42 excited by the feeding portion 41 and the parasitic element 43 that is coupled electrically with the antenna element 42. That is, the antenna element 42 mainly operates as the radiator/receiver in the city phone system, while the parasitic element 43 operates as the radiator/receiver in the PHS system.

Thus, the frequency band of this antenna unit in which the VSWR is 2.5 or less exists in about 1425 to 1505 MHz and about 1870 to 1930 MHz, and also a sum of bandwidths becomes about 140 MHz. Therefore, the incorporation of the parasitic element 43 yields the wider bandwidth.

Also, the radiation directivity of the present antenna unit results in the strong radiation in the +X1 direction rather than the −X1 direction since the parasitic element 43 acts as the waveguide element. Also, the degradation of the antenna gain is easily brought about by the influence of the board and electronic parts in the housing 11 if the radiation to the inward direction of the housing 11 is enhanced on the contrary to this embodiment. However, in this embodiment, the good antenna performance can also be obtained by enhancing the radiation in the outward direction.

Also, the SAR value can be reduced because the peak points are scattered into three points α, β, γ during when the mobile phone 40 is used in the city phone system. In contrast, in the PHS system, the antenna current concentrates at the peak point γ on the parasitic element 43, but the SAR value can be disregarded because the maximum transmitting power is small like 80 mW.

In this embodiment, according to the present embodiment, the antenna current is induced in the antenna element 42 in the city phone system, while the antenna current is induced in the parasitic element 43 in the PHS system by the spatial coupling between the antenna element 42 and the parasitic element 43. Therefore, this antenna unit can meet the dual band without addition of the matching circuit, and also expansion of the parts packaging space on the board and reduction in the number of packaged parts can be achieved. Also, the peak points of the current can be scattered and the SAR value can be reduced.

Also, in this embodiment, the strip-like metal plate may be used as the antenna element 42 and the parasitic element 43. Also, the similar advantages can be achieved by holding appropriately the antenna element 401 and the parasitic element 403 in the interior of the housing 11. Also, the antenna element 42 may be composed of the monopole antenna whose effective length corresponds to the half wavelength.

Fifth Embodiment

Figure 8:
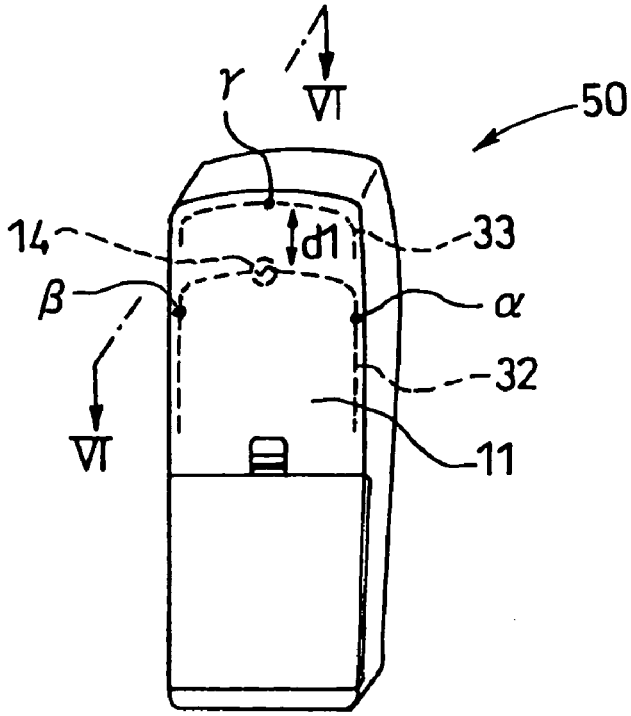
FIG. 8 is a schematic perspective view showing a mobile phone into which an antenna unit according to a fifth embodiment is incorporated.
Figure 9:
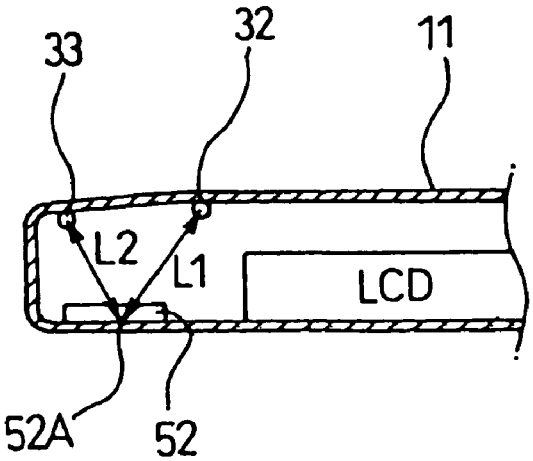
FIG. 9 is a sectional view showing the mobile phone according to the fifth embodiment and taken along a IX—IX line in FIG. 8.

FIG. 8 is an appearance view of a mobile phone 50 into which an antenna unit according to a fifth embodiment of the present invention is incorporated. FIG. 9 is a sectional view of the mobile phone 50 taken along a IX—IX line in FIG. 8. In this case, in this fifth embodiment, the same reference symbols are affixed to the same portions as those in the third embodiment shown in FIG. 6 and their explanation will be omitted herein.

In the mobile phone 50 shown in FIG. 8 and FIG. 9, unlike the mobile phone 30 in the third embodiment, an earpiece portion 52 as well as the antenna element 32 and the parasitic element 33 is built in the rod-like housing 11. In this embodiment, the housing 11 has the same lengths in the longitudinal direction, the width direction, and the thickness direction as the housing in the third embodiment respectively. Here, a sound source of the earpiece portion 52 is indicated by a listening point 52A in FIG. 9.

The antenna element 32 is pasted and arranged on the inner wall surface of the housing 11, which is separated from the listening point 52A by an air clearance L1. The parasitic element 33 is pasted and arranged on the inner wall surface of the housing 11, which is separated from the listening point 52A by an air clearance L2. Here, the air clearance L1 between the listening point 52A and the antenna element 32 is set larger than the air clearance L2 between the listening point 52A and the parasitic element 33, i.e., $$L1>L2 \tag{2}$$

The earpiece portion 52 is a speaker that converts the electric signal into the sound, and uses the listening point 52A as the sound source. The listening point 52A is constructed by boring holes through the housing 11 to pass the sound easily. Normally, the user's ear makes contact with this listening point in the speaking state.

Next, an operation of the antenna unit according to this embodiment will be explained hereunder.

The transmission/reception of the radio wave are executed by the balanced antenna element 32 excited by the feeding portion 52 and the parasitic element 33 that is coupled electrically with the antenna element 32. The antenna element 32 mainly acts as the radiator in the transmitting band, while the parasitic element 33 acts as the receiver in the receiving band.

(I) Therefore, in the situation that the user puts the listening point 52A to the user's ear at the time of transmitting the radio wave, the SAR value can be reduced since the distance L1 between the user's ear (listening point 52A) and the antenna element 32 (the peak points α, β), at which the antenna current is generated strongly in the transmitting state, can be set larger than the distance L2, as indicated by Inequality (2).

In this manner, since the antenna current is induced mainly in the antenna element 32 at the time of transmission, the air clearance L1 between the user's ear (listening point 52A) and the peak points α, β of the antenna current can be extended and thus the SAR value can be reduced.

(II) In contrast, the antenna current is induced mainly in the parasitic element at the time of reception, and the air clearance L2 between the user's ear and the peak point γ of the antenna current becomes small rather than the air clearance at the time of transmission. But there is no problem because the SAR value is required only of the transmitting operation.

Also, in this embodiment, the similar advantages can be achieved even though the strip-like metal plate is used as the antenna element 32 and the parasitic element 33. Also, the similar advantages can be achieved by holding appropriately the antenna element 32 and the parasitic element 33 in the interior of the housing 11. Also, the similar advantages can be achieved even though the antenna element 32 is composed of the monopole antenna whose effective length corresponds to the half wavelength.

Sixth Embodiment

Figure 10:
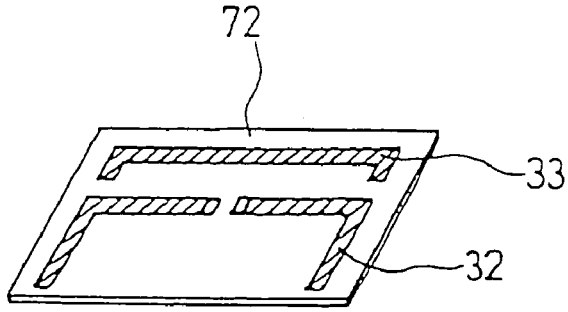
FIG. 10(A) is a perspective view showing an antenna unit according to a seventh embodiment, (B) is a schematic perspective view showing a mobile phone into which this antenna unit is incorporated, and (C) is a sectional view taken along a XII—XII line in (B)
Figure 10:
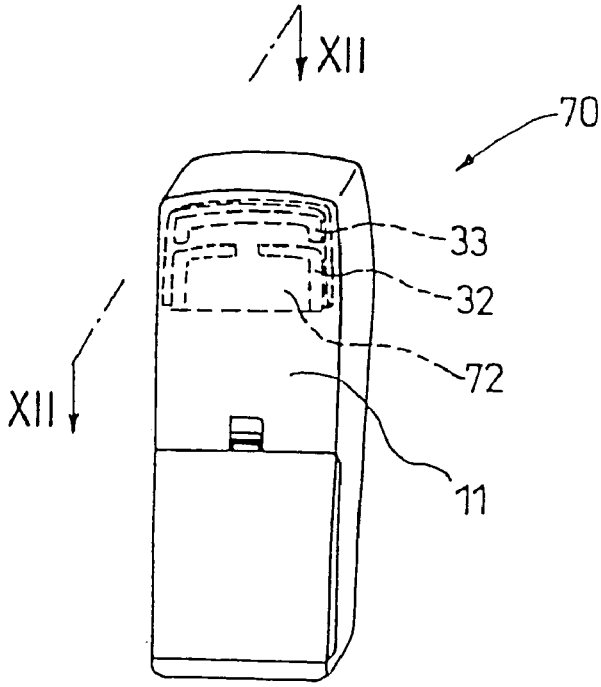
Figure 10:
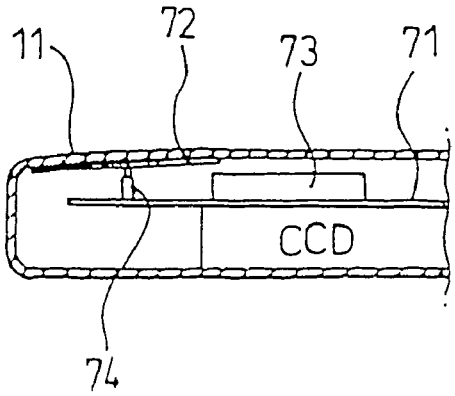
Figure 11:
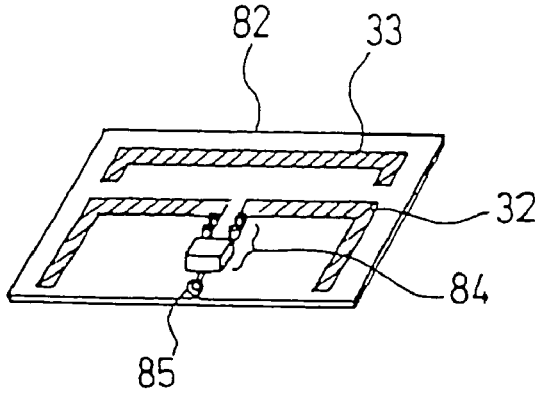
FIG. 11(A) is a perspective view showing an antenna unit according to an eighth embodiment, (B) is a schematic perspective view showing a mobile phone into which this antenna unit is incorporated, and (C) is a sectional view taken along a XIII—XIII line in (B)
Figure 11:
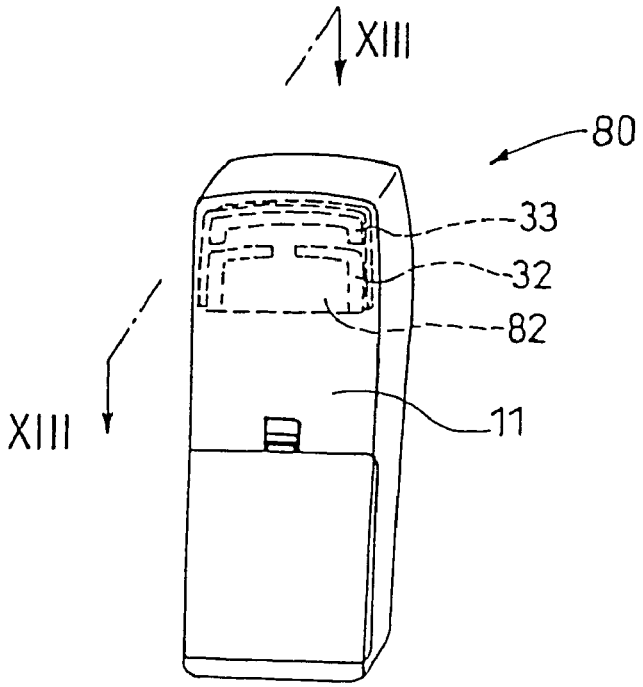
Figure 11:
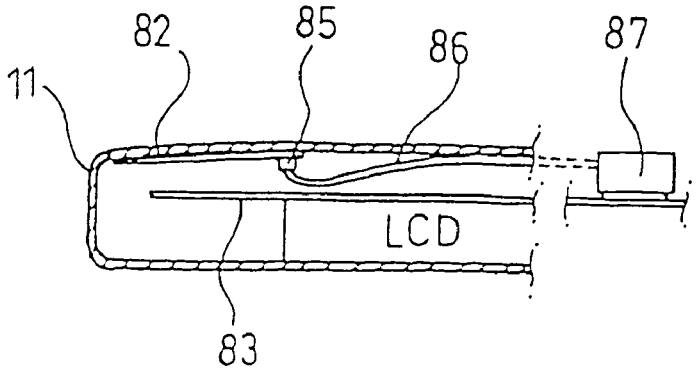

FIG. 10 is an appearance view of a mobile phone 60 into which an antenna unit according to a sixth embodiment of the present invention is incorporated. FIG. 11 is a sectional view of the mobile phone 60 taken along a XI—XI line in FIG. 10. In this case, in this embodiment, the same reference symbols are affixed to the same portions as those in the second embodiment shown in FIG. 5 and their explanation will be omitted herein.

In the mobile phone 60 shown in FIG. 10 and FIG. 11 in the sixth embodiment, the antenna element 22 and the parasitic element 23 are provided to the inside of the rod-like housing 11 and also an earpiece portion 62 is built in the housing 11. In this case, the housing 11 has the same lengths in the longitudinal direction, the width direction, and the thickness direction as the housing in the second embodiment respectively.

Also, as the communication system applied herein, like the second embodiment, for example, the receiving frequency of 2300 MHz to 2350 MHz and the transmitting frequency of 2400 MHz to 2450 MHz are employed respectively and thus the receiving frequency is set lower than the transmitting frequency.

The antenna element 22 is pasted and arranged on the inner wall surface of the housing 11, which is separated from the listening point 62A by the air clearance L1. The parasitic element 23 is pasted and arranged on the inner wall surface of the housing 11, which is separated from the listening point 62A by the air clearance L2.

The earpiece portion 62 is a speaker that converts the electric signal into the sound, and uses the listening point 62A as the sound source, like the earpiece portion 52 in the fifth embodiment. The listening point 62A is also constructed by boring holes through the housing 11 to pass the sound easily. Normally, the user's ear makes contact with this listening point in the speaking state.

Also, in contrast to the fifth embodiment, the air clearance L1 between the listening point 62A and the antenna element 22 is set smaller than the air clearance L2 between the listening point 62A and the parasitic element 23, i.e., $$L1<L2 \quad (3)$$

Next, an operation of the antenna unit according to this embodiment will be explained hereunder. In this embodiment, the transmission/reception of the radio wave are executed by the balanced antenna element 22 excited by the feeding portion 14 and the parasitic element 23 that is coupled electrically with the antenna element 22.

Seventh Embodiment

Next, a seventh embodiment will be explained with reference to FIGS. 10(A) to 10(C) hereunder.

FIG. 10(A) is a perspective view of a printed board 72 constituting a pertinent portion of an antenna unit according to the seventh embodiment of the present invention, 10(B) is an appearance view of a mobile phone 70 into which the printed board 72 is incorporated, and 10(C) is a sectional view of the mobile phone 70 taken along a XII—XII line in FIG. 10(B). In this case, in this embodiment, the same reference symbols are affixed to the same portions as those in the third embodiment and their explanation will be omitted herein.

This mobile phone 70 has the same basic configuration as the mobile phone 30 shown in FIG. 6 in the third embodiment. As shown in FIG. 12(C), a main board 71, the printed board 72, etc. are provided in the inside of the housing 11.

The antenna element 32 and the parasitic element 33 are constructed on this printed board 72 as printed patterns. As shown in FIG. 12(C), the printed board 72 is secured to the inner wall surface of the housing 11 of the mobile phone 70.

Here, as the particular fixing method of this printed board 72, for example, the method of adhering this printed board by using the adhesive and the double-faced tape, the method of providing ribs on the inner wall surface of the housing 11 and then fitting the printed board 72 between the ribs, etc. may be employed.

The antenna element 32 is constructed to receive a signal set from a radio portion 73 on the main board 71 via a feeding pin 74. The feeding pin 74 is formed of a conductive metal, for example, to a top end portion of which a spring structure is provided.

According to such structure, since the antenna element 32 and the parasitic element 33, which are prepared as individual parts in the prior art, can be constructed by the printed patterns formed on a sheet of printed board 72, the number of articles can be reduced. Also, the air clearance between the antenna element 32 and the parasitic element 33 can be formed and fixed with high precision, and at the same time this structure is excellent in mass-producibility. Also, the similar advantages can be achieved even though the antenna element 32 is composed of the monopole antenna whose effective length corresponds to one wavelength.

Eighth Embodiment

Next, an eighth embodiment will be explained with reference to FIGS. 11(A) to 11(C) hereunder.

In FIG. 11, (A) is a perspective view of a printed board 82 constituting a pertinent portion of an antenna unit according to an eighth embodiment of the present invention, 11(B) is an appearance view showing a mobile phone 80 into which the printed board 82 is incorporated, and 11(C) is a sectional view of the mobile phone 80 taken along a XIII-13 XIII line in FIG. 11(B) In this case, in this embodiment, the same reference symbols are affixed to the same portions as those in the third embodiment shown in FIG. 6 and their explanation will be omitted herein.

This mobile phone 80 has the same basic configuration as the mobile phone 30, and the printed board 82, a main board 83, etc. are provided in the inside of the housing 11.

In the printed board 82 shown in FIG. 10(A), the antenna element 32 and the parasitic element 33 are constructed on this printed board 82 as the printed patterns.

Also, a packaged parts 84 and a connector connection terminal 85 are provided onto the printed board 82. As shown in FIG. 10(B) and 10(C), the printed board 82 is secured to the inner wall surface of the housing 11 of the mobile phone 80. Here, as the particular fixing method of this printed board 82, for example, the method of adhering this printed board by using the adhesive and the double-faced tape, the method of providing ribs on the inner wall surface of the housing 11 and then fitting the printed board 82 between the ribs, etc. may be employed.

As the packaged parts 84, for example, an antenna matching circuit, a balance-to-unbalanced transducer (balun), and the like are listed, and packaged on the printed board 82. Also, the connector connection terminal 85 is connected to a radio portion 87 on the main board 83 via a coaxial cable 86.

According to such structure, the packaged parts 84 that are packaged originally on the main board 83 can be packaged on the printed board 82 as another board, and correspondingly a packaging space on the main board 83 can be expanded. In this case, the similar advantages can be achieved even if the power is fed by using the feeding pin 74 set forth in the seventh embodiment in place of the connector connection terminal 85 and the coaxial cable 86. Also, in this embodiment, the similar advantages can be achieved even though the antenna element 32 is composed of the monopole antenna whose effective length corresponds to one wavelength.

With the above, the mobile phone 80 using the rod-like housing 11 is explained in the eighth embodiment. However, the present embodiment can be applied similarly to a foldable mobile phone 90 shown in FIG. 14, for example. In this case, in FIG. 12 a reference numeral 91 denotes a liquid crystal display portion (LCD)

Figure 12:
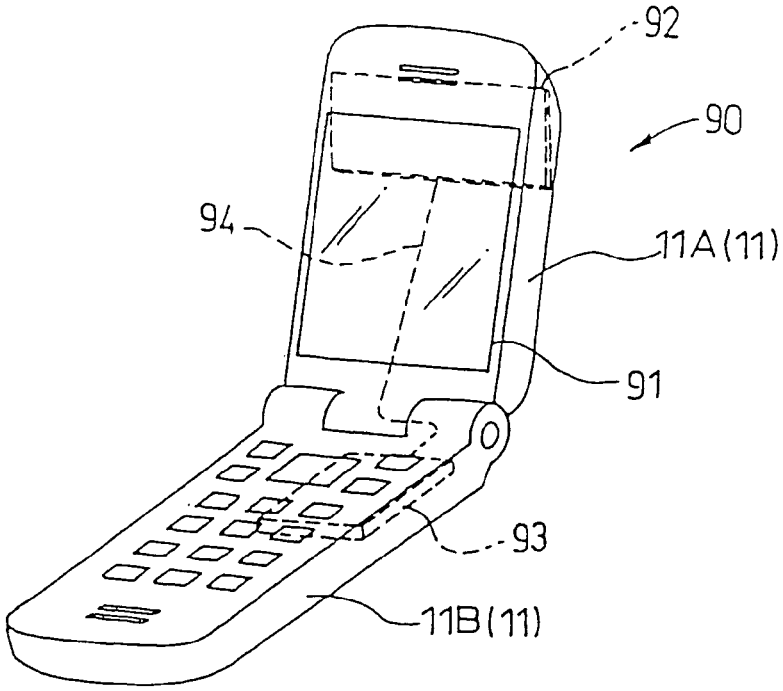
FIG. 12 is a schematic perspective view showing a foldable mobile phone into which the antenna unit according to the eighth embodiment is incorporated.

More particularly, in the foldable mobile phone 90 shown in FIG. 12, a printed board 92, which corresponds to the printed board 82 in the embodiment shown in the same figure, and a radio portion 93 may be packaged on an upper housing 11A and a lower housing 11B respectively. In this event, in this foldable mobile phone 90, the printed board 92 and the radio portion 93 can be connected directly via a coaxial cable 94.

In the prior art, in the case of such configuration, the power is fed to the antenna unit by connecting the radio portion in the lower housing and the main board in the upper housing via the coaxial cable and connecting electrically the main board and the antenna element by using the feeding pin, or the like. As a consequence, in the foldable mobile phone in the prior art, the parts such as the feeding ping, etc. are needed. In contrast, in the foldable mobile phone having the structure according to the present invention shown in FTG. 12, the feeding ping, etc. can be omitted and thus the number of articles can be reduced.

Ninth Embodiment

Next, a ninth embodiment will be explained with reference to FIG. 13 hereunder.

Figure 13:
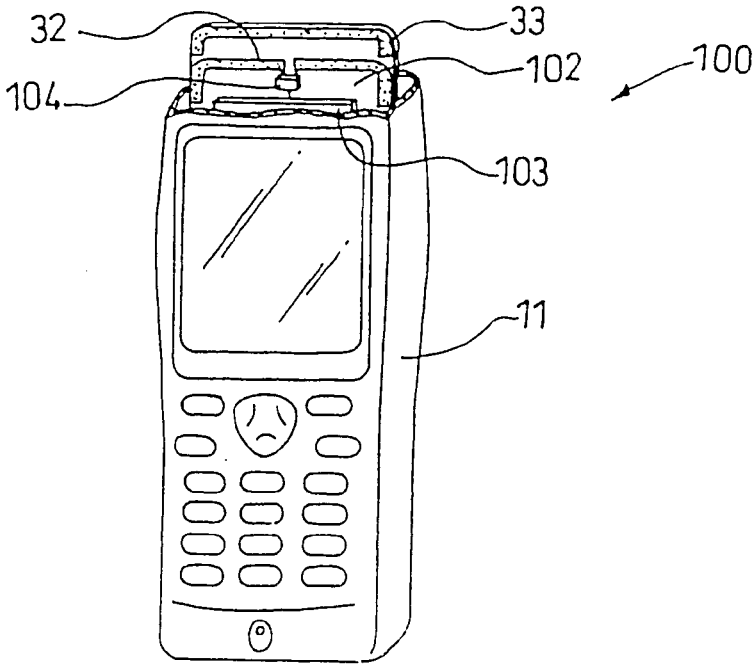
FIG. 13 is a partially-broken perspective view showing a mobile phone into which an antenna unit according to a ninth embodiment is incorporated.

FIG. 13 is a partially-broken perspective view of a mobile phone 100 into which an antenna unit according to a ninth embodiment of the present invention is incorporated. In this case, in this embodiment, the same reference symbols are affixed to the same portions as those in the third embodiment shown in FIG. 6 and their explanation will be omitted herein.

The mobile phone 100 has the same basic configuration as the mobile phone 30 in the third embodiment, and has a printed board 102 in the interior of the housing 11. Also, a not-shown radio portion, a feeding portion 104, and the antenna element 32 and the parasitic element 33, both being formed of the printed pattern, are packaged on this printed board 102. The radio portion is connected electrically to the antenna element 32 via the feeding portion 104 and is constructed to transmit/receive the signal.

When using such structure, the number of articles can be reduced because there is no necessity to construct the antenna element 32 and the parasitic element 33 as the individual parts. Also, the air clearance between the antenna element 32 and the parasitic element 33 can be formed and fixed with high precision, and also this structure is excellent in the mass-producibility. Also, the similar advantages can be achieved even though the antenna element 32 is composed of the monopole antenna whose effective length corresponds to one wavelength.

Tenth Embodiment

Next, a tenth embodiment will be explained with reference to FTG. 14 hereunder.

Figure 14:
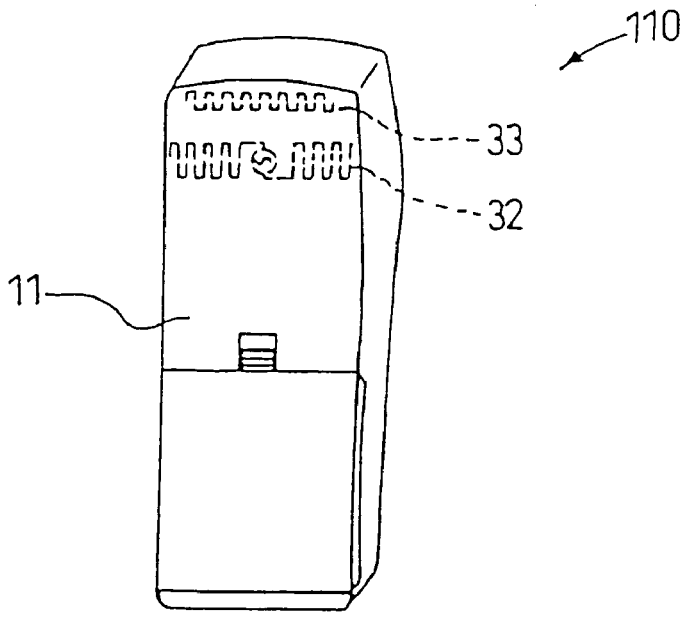
FIG. 14 is a schematic perspective view showing a back surface of a mobile phone into which an antenna unit according to a tenth embodiment is incorporated.

FIG. 14 is an appearance view of a mobile phone 110 into which an antenna unit according to a tenth embodiment of the present invention is incorporated. In this case, in this embodiment, the same reference symbols are affixed to the same portions as those in the third embodiment and their explanation will be omitted herein.

The mobile phone 110 according to this tenth embodiment has also the same basic configuration as the mobile phone 30 shown in FIG. 6 in the third embodiment, and has the meander antenna element 32 and the meander parasitic element 33 in the rod-like housing 11. In this manner, since the antenna element 32 and the parasitic element 33 are shaped like the meander shape, both electrical lengths of the antenna element 32 and the parasitic element 33 can be tuned to a desired frequency band relatively freely. In addition, these elements can be formed together compactly to reduce the size.

Therefore, according to this configuration, these elements can be constructed small in size by forming the antenna element 32 and the parasitic element 33 like the meander. In this case, only any one of the antenna element 32 and the parasitic element 33 may be formed in the meander fashion to reduce the size. Also, the similar advantages can be achieved even though the antenna element 32 and the parasitic element 33 are formed helically.

Eleventh Embodiment

Next, an eleventh embodiment will be explained with reference to FIG. 15 hereunder.

Figure 15:
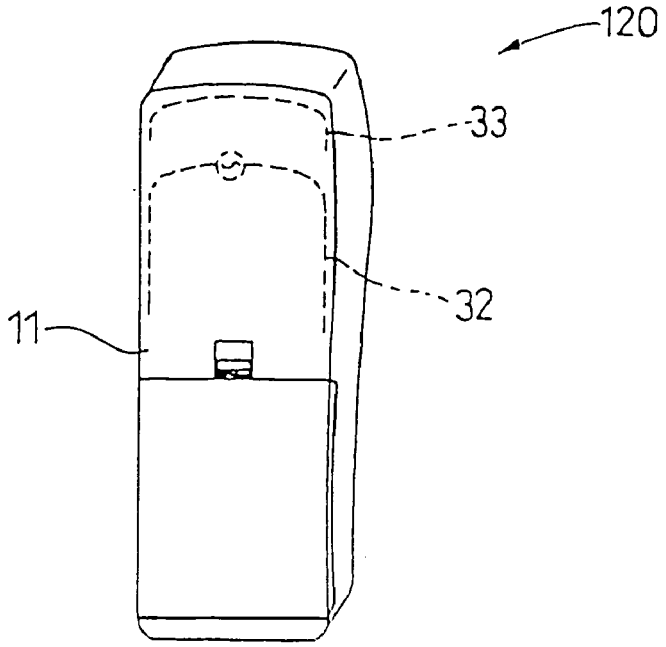
FIG. 15 is a schematic perspective view showing a mobile phone into which an antenna unit according to an eleventh embodiment is incorporated.

FIG. 15 is a schematic perspective view of a mobile phone 120 into which an antenna unit according to an eleventh embodiment of the present invention is incorporated. In this case, in this embodiment, the same reference symbols are affixed to the same portions as those of the mobile phone 30 shown in FIG. 6 in the third embodiment and their explanation will be omitted herein. This mobile phone 120 has also the same basic configuration as the mobile phone 30 in the third embodiment. The mobile phone 120 has the antenna element 32 being fed balancedly in the interior of the rod-like housing 11. This antenna element 32 is composed of the dipole antenna like the third embodiment.

Such balanced feeding of the antenna element 32 makes it difficult for the antenna current to flow through the housing 11 of the mobile phone 120. As a result, the antenna that is seldom affected by the user's hand when the user holds the phone in use can be realized, and thus the excellent antenna characteristics can be kept/realized in the actual service condition.

As described above, according to the present invention, because the antenna unit having the antenna element and the parasitic element is built in the portable radio device, the wider bandwidth can be realized and also the good antenna performance can be realized by controlling the radiation directivity. In addition, according to this invention, because the antenna is never exposed to the outside of the housing, the antenna unit and the portable radio device, which are in no way damaged by the contact, have a high reliability, and are convenient to use, can be implemented.

In addition, according to the present invention, because the SAR value can be reduced by scattering the peak point of the antenna current into plural points, the antenna unit and the portable radio device, which are excellent in respect of safety, can also be realized.

The present invention is explained in detail with reference to particular embodiments. But it is apparent for the person skilled in the art that various variations and modifications may be applied without departing a spirit and a scope of the present invention.

This application is filed based on Japanese Patent Application No.2002-38546 filed on Feb. 15, 2002 and the contents thereof are incorporated by the reference herein.

INDUSTRIAL APPLICABILITY

According to the present invention, since the antenna unit having the antenna element and the parasitic element is built in the portable radio device, the wider bandwidth can be realized and also the good antenna performance can be realized by controlling the radiation directivity.

Also, according to this invention, since the antenna is never exposed to the outside of the housing by incorporating the antenna element and the parasitic element into the interior of the housing of the portable radio device, the antenna unit and the portable radio device, which are by no means damaged by the contact, have a high reliability, and are convenient to use, can be realized.

The invention claimed is:

1. A portable radio device including an antenna unit, the antenna unit comprising:

an antenna element and a parasitic element, wherein the antenna element has an effective length corresponding to a half wavelength or one wavelength of a transmitting frequency, to induce an antenna current that radiates a radio wave in the transmitting frequency, the parasitic element has an effective length corresponding to a half wavelength of a receiving frequency, to induce another antenna current by a spatial coupling with the antenna element upon receiving the radio wave in the receiving frequency, the transmitting frequency is lower than the receiving frequency, and the parasitic element is arranged at an upper end side in the longitudinal direction of the portable radio device.

2. A portable radio device including an antenna unit, the antenna unit comprising:

an antenna element and a parasitic element, wherein the antenna element has an effective length corresponding to a half wavelength of a receiving frequency, to induce an antenna current upon receiving a radio wave in the receiving frequency, the parasitic element has an effective length corresponding to a half wavelength of a transmitting frequency, to induce an antenna current for radiating a radio wave in the transmitting frequency by a spatial coupling with the antenna element, the receiving frequency is lower than the transmitting frequency, the parasitic element is arranged at an upper end side in the longitudinal direction of the portable device.

3. A portable radio device including an antenna unit, that executes transmission/reception between a first communication system and a second communication system, using radio waves in a plurality of different wavelength bands in said first and second communications systems, a frequency band in the first communication system is lower than a frequency band in the second communication system, and a maximum transmitting power of the first communication system is higher than that of the second communication system, said antenna unit comprising:

an antenna element and a parasitic element, wherein the antenna element has an effective length corresponding to a half wavelength or one wavelength of a frequency in the first communication system, to induce an antenna current upon using the first communication system, and the parasitic element has an effective length corresponding to a half wavelength of a frequency in the second communication system, to induce another antenna current in the parasitic element by a spatial coupling with the antenna element upon using the second communication system, the parasitic element is arranged at an upper end side in the longitudinal direction of the portable radio device.

4. The portable radio device including an antenna unit according to any one of claim 1 or claim 3, wherein the portable radio device comprises a listening point, wherein the antenna element and the parasitic element are arranged at a face opposed to a face on which the listening point is provided, and wherein a distance between the listening point and the antenna element is set larger than a distance between the listening point and the parasitic element.

5. The portable radio device including an antenna unit according to any one of claims 1 to 3, wherein the antenna element and the parasitic element are formed by printed patterns on a sheet of printed board.

6. The portable radio device including an antenna unit according to claim 3, wherein electronic parts are packaged on the printed board.

7. The portable radio device including an antenna unit according to any one of claims 1 to 3, wherein the portable radio device further comprises a radio portion and a printed board on which the radio portion is mounted, and wherein the antenna element and the parasitic element are formed by printed patterns on the printed board.

8. The portable radio device including an antenna unit according to any one of claims 1 to 3, wherein any one or both of the antenna element and the parasitic element is or are shaped like a meander shape.

9. The portable radio device including an antenna unit according to any one of claims 1 to 3, wherein the antenna element is balancedly fed.

10. The portable radio device including an antenna unit according to any one of claims 1 to 3, wherein the antenna element and the parasitic element are arranged in an interior of a housing of the portable radio device.

* * * * *